US005355541A

United States Patent [19]

Rutter et al.

[11] Patent Number: 5,355,541

[45] Date of Patent: Oct. 18, 1994

[54] EQUIPMENT FOR THE MACHINE WASHING OF CLOTHES AND THE METHOD OF UTILIZING THE SAME

[75] Inventors: Philippa J. Rutter, Durhan, Great Britain; Henri Cornette, Pointoise, France; John Bailey, Newcastle Upon Tyne, Great Britain; Gerard Bocquet, Neuilly Sur Seine, France; Aude Bouraoui-Karoui, Strombeek-Bever, Belgium; Gilbert Laurenty, Paris, France

[73] Assignee: The Proctor & Gamble Company, Cincinnati, Ohio

[21] Appl. No.: 64,109

[22] PCT Filed: Nov. 25, 1991

[86] PCT No.: PCT/US91/08824

§ 371 Date: May 25, 1993

§ 102(e) Date: May 25, 1993

[87] PCT Pub. No.: WO92/09737

PCT Pub. Date: Jun. 11, 1992

[30] Foreign Application Priority Data

Nov. 30, 1990 [FR] France ..... 90 15064

[51] Int. Cl.[5] ..... D06F 39/02

[52] U.S. Cl. ..... 8/158; 68/17 R; 206/0.5; 252/90

[58] Field of Search ..... 8/137, 158, 159; 68/17 R, 235 R; 206/0.5, 216; 222/463, 478, 547, 564; 252/90, 174; 401/126, 129, 130

[56] References Cited

U.S. PATENT DOCUMENTS

| | | | |
|---|---|---|---|
| 4,703,872 | 11/1987 | Cornette et al. | 222/158 |
| 4,720,351 | 1/1988 | Flynn et al. | 252/90 |
| 4,835,804 | 6/1989 | Arnau-Munoz et al. | 8/158 |
| 4,944,165 | 7/1990 | Leebeek et al. | 68/17 R |

FOREIGN PATENT DOCUMENTS

| | | |
|---|---|---|
| 0327704A1 | 8/1989 | European Pat. Off. . |
| 0328863A1 | 8/1989 | European Pat. Off. . |
| 0328987A1 | 8/1989 | European Pat. Off. . |
| 2563250A1 | 10/1985 | France . |
| 2570720A1 | 3/1986 | France . |
| 2629433A3 | 10/1989 | France . |

*Primary Examiner*—Philip R. Coe

*Attorney, Agent, or Firm*—William Scott Andes; E. Kelly Linman; Dean L. Garner

[57] ABSTRACT

The equipment comprises a measuring and dispensing device of the reusable type for the machine washing of clothes, which comprises a hollow body (1) intended to receive the amount of liquid detergent prescribed for the wash, said body being provided with at least one filling opening (3) and outlets (7b) for the distribution of said product or products, as well as means (8) enabling the user to effect, once said device has been filled, the easy and controlled application of at least one product contained in it to selected areas of the clothing before the latter is subjected to washing in the machine, for the purpose of effecting the pretreatment of said areas before the washing cycle, said measuring and dispensing device, containing the amount of product remaining after the pretreatment, being introduced into the machine together with the clothes, said pretreatment means (8) being removable from the body of said device.

18 Claims, 7 Drawing Sheets

EQUIPMENT FOR THE MACHINE WASHING OF CLOTHES AND THE METHOD OF UTILIZING THE SAME

The present invention relates to measuring and dispensing equipment or a measuring and dispensing device of the reusable type for the machine washing of clothes, and also to the method of utilizing the same.

More particularly, the invention relates to a measuring and dispensing device of a type which is now standard and which enables the method of machine washing of clothes described in the Applicant's patent FR 2563250 to be carried out and is intended to be filled with at least one liquid detergent, thereupon being placed in the drum of the machine together with the clothes to be washed and then being progressively emptied of its contents in the course of the washing cycle. Measuring and dispensing devices of this kind have been described, inter alia, in the Applicant's patent application published under No. FR-2570720. This application concerns measuring and dispensing devices each of which comprises a body, particularly one of mainly spherical shape, which is intended to contain a detergent liquid and which has a filling opening and is associated with an attached assembly which may form a lid, capping said opening. Said attached assembly and/or said body are provided with outlets intended to permit the progressive discharge of the liquid amongst the clothes in the course of the washing.

It is known that, in order to obtain a good degree of cleanness, it is often necessary for certain areas of garments, such as for example particularly soiled areas, such as individual spots, or areas habitually more heavily soiled, such as shirt collars and cuffs, to .be treated before the wash. This pretreatment generally consists of simple prewashing with soap, in particular with a solid soap and a brush, so that the user must first provide himself with objects, namely the soap and the brush, other than those needed for the machine wash.

In this respect it should be noted that measuring and dispensing devices known hitherto, and also the bottles containing detergent liquids intended for machine washing, are completely unsuitable for enabling a user to pour detergent liquid onto a particular area of a garment in a sufficiently controlled manner, since in order no do so the user must equip himself with a separate container.

In particular, large capacity containers are difficult to manipulate. It is therefore usually necessary to make use of separately presented pretreatment products, and containers for such products have been developed and are available on the market: products applied by spraying are for example known. Apart from inconvenience to the user— since two different containers must be used, one for the detergent and the other for the pretreatment product— pretreatment with an additional product increases the total cost of the wash.

The present invention seeks to obviate these disadvantages and provides a measuring and dispensing device associated with pretreatment means making it possible to achieve controlled application of a detergent liquid, with which it has been filled for the purpose of the machine wash, to selected areas of a garment for the purpose of effecting a pretreatment of these areas before the washing cycle. The user therefore no longer needs to provide an object or a container which would be used solely for this specific pretreatment stage.

The subject of the present invention is therefore equipment comprising a measuring and dispensing device of the reusable type for the machine washing of clothes, which comprises a hollow body closed at one end by a base and intended to receive the amount prescribed for the wash of at least one product which can be used for washing, such as a liquid detergent or a washing additive, said hollow body being provided with at least one filling opening and with outlets for the distribution of said product or products, the measuring and dispensing device being intended to be placed, together with the clothes to be washed, in the drum of the machine, where it is progressively emptied of its contents in the course of the washing cycle, and being characterized in that it is provided with means enabling a user to effect, once the device has been filled, a controlled application of at least one product contained in it to selected areas of a garment, for the purpose of pretreating said areas before the washing cycle, the measuring and dispensing device, containing the amount of product remaining after the pretreatment, being introduced into the machine together with the clothes, and in that said pretreatment means are removable from the body of said device.

The adjective "removable" describing the pretreatment means signifies that said means can actually be detached from the measuring and dispensing device, particularly while it is being filled or during its use in the washing machine, or that these means can occupy various positions relative to the body of the device depending on whether the latter is being used for the pretreatment or for washing in the machine. Thus, depending on the construction, the pretreatment means are thus placed, or are not placed, in the drum of the machine together with the measuring and dispensing device.

According to an advantageous characteristic of the invention the device is filled at the start with the entire amount of useful product, such as the liquid detergent, required for a washing cycle. A fraction of the contents of the device is applied, during the pretreatment, to the selected areas of garments. The residual amount of product is distributed, in the course of the wash, by the measuring and dispensing device placed in the machine together with the clothes. It will be noted that the total amount of useful product will thus be brought into contact with the clothes, namely the amount applied to the areas of garments during the pretreatment and the amount contained in the device and distributed from the latter. It has surprisingly been found that the invention thus achieved even greater effectiveness in respect of stain removal because of the pretreatment, although the amount of product consumed is the same as with the previous technique described at the beginning of the present description.

The present invention also relates to the following characteristics, considered singly or in all their technically possible combinations:

- the pretreatment means comprise means enabling the liquid product to be applied to be distributed over the areas which are to be pretreated;
- said means comprise an applicator member adapted to receive, particularly by impregnation, the liquid which is to be distributed;
- said applicator member ends in a handle fastened to an attached assembly intended to cap the filling opening of said device, said member and said handle extending inside the body of said device when said attached assembly is in position on the latter;

said member is an applicator pad;

said applicator pad is adapted to be fixed sealingly in the filling and distribution opening of the device;

said member is a brush;

said brush has a handle which extends an outlet chimney provided on an attached assembly intended to cap the filling opening of the device;

the height of said brush does not exceed the height of the body of said device;

the equipment is provided with an attached assembly which forms a lid and of which the part forming a lid is provided with numerous small apertures intended to enable a user to spread by sprinkling a controlled amount of useful product over areas of clothing which are to be pretreated, said attached assembly being adapted to pivot on the body of the device between a position in which it closes the outlets of said body and a position in which said outlets are not closed but bring the interior of the device into communication with the exterior;

the body of the device is provided with outlets on a part which forms a rim and at the level of which the filling opening of the device is situated, the attached assembly forming a lid being adapted to pivot on said part which forms a rim about said filling open and being provided on its periphery with closure legs which are disposed and shaped in such a manner that, in one position of the attached assembly on said body, the outlets distributed over the part of the body forming a rim are closed by said legs, which are placed over them, and in that in another position said outlets are no longer closed;

the attached assembly has a dome-shaped lid part, the body with which said attached assembly is associated being provided with a complementary subdome equipped with distribution outlets, while the dome of the part forming a lid is in turn equipped with complementary outlets which, in one of the relative positions of said attached assembly in relation to said body, are adapted to assume a juxtaposed position relative to said distribution outlets in order to establish communication between the interior of the device and the exterior and, in another position, to interrupt this communication;

the pretreatment means comprise a member intended to be fastened to the body of the device or to an assembly attached to the latter, said member having a pouring spout or channel communicating with the interior of said body when said member is in position on the latter or on its attached member;

the equipment has a wall forming a valve which, depending on whether it is or is not stressed, controls communication between the interior of the device and a product application member;

said product application member comprises a hollow tube which extends inside the body of said device, passing through the base of the latter and ending, outside the device, in an application surface, the wall which delimits said tube in the interior of the body being deformable and provided with at least one slit forming a valve which, if a compressive force sufficient to deform said wall is applied to the application surface, will open and bring the interior of said body containing the product into communication with the interior of said hollow tube, thus enabling the product to reach the terminal application surface;

said application surface is provided with irregularities.

Another subject of the invention is a method of utilizing the equipment, wherein the measuring and dispensing device is filled with at least liquid detergent, a controlled amount of said detergent is applied to selected areas of the clothing with the aid of the removable pretreatment means, and the measuring and dispensing device is then placed in known manner in the drum of the machine together with the clothes to be washed, the measuring and dispensing device, containing the amount of product remaining after the pretreatment, being introduced into the machine together with the clothes.

The following descriptions of various embodiments of the invention are purely illustrative and non-limitative. They must be read with reference to the accompanying drawings, in which.

Figure 1:
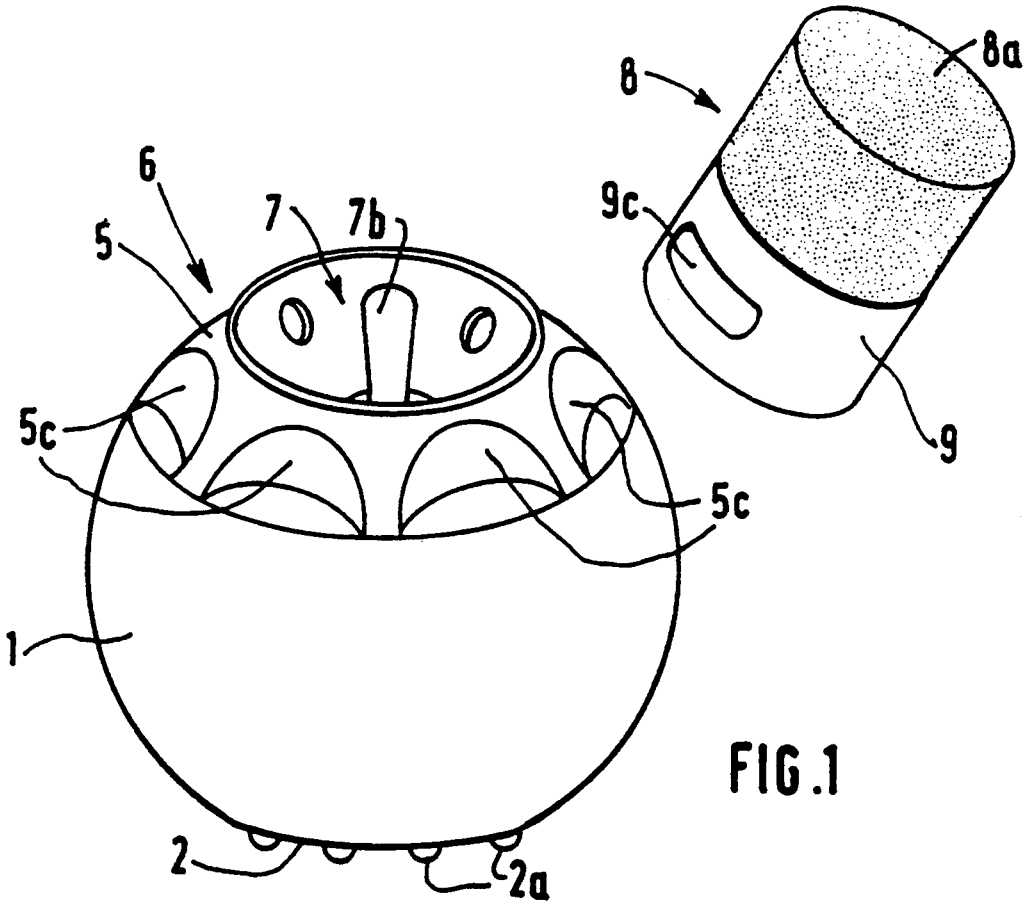
FIGS. 1 and 2 are views in perspective and in axial section of a measuring and dispensing device according to a first embodiment of the invention.
Figure 2:
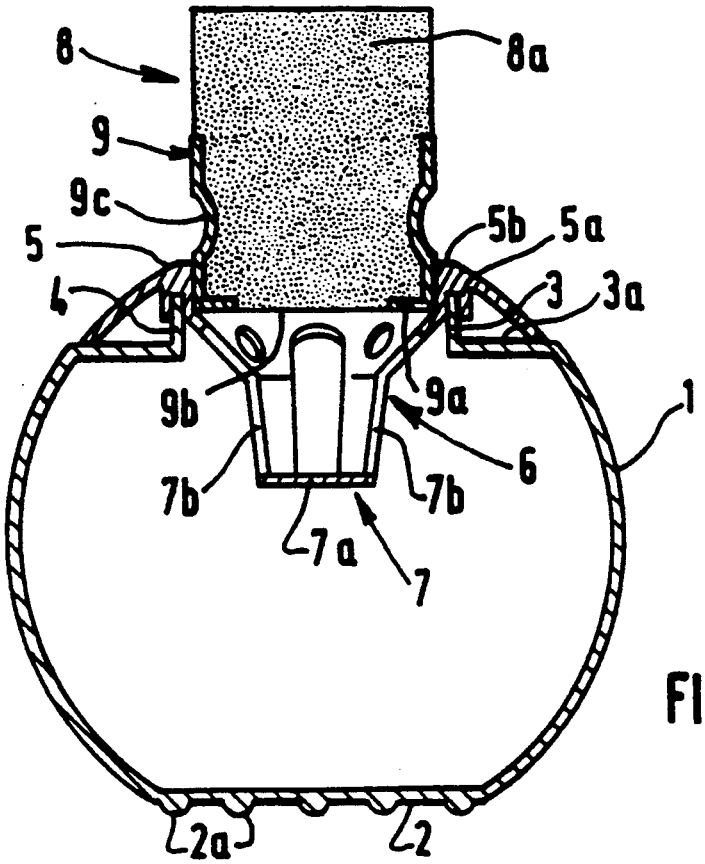

It can be seen in FIGS. 1 and 2 that a measuring and dispensing device according to a first embodiment of the invention comprises a body 1 of mainly spherical shape, with a base 2 having a flat surface, and with a circular opening 3-surrounded on its periphery by an annular cylindrical skirt 4 extending from the rim 3*a* of the body 1. The base 2 is provided with irregularities 2*a*, which for example consist of hemispherical studs of small dimensions distributed regularly over its entire external surface.

The skirt 4 cooperates with a complementary groove 5*a* provided on an inside cylindrical supporting wall 5*b* of a collar 5 of an assembly 6 attached over the opening 3. The attached assembly 6 comprises a chimney-shaped part 7 which penetrates into the body 1, passing through the opening 3 and the support skirt 4. This chimney 7 has a shape delimited by two truncated cones and widens out from its base inside the body 1 as far as its support wall 5b. The base of the chimney 7, inside the body 1, is closed by a bottom 7a. The frustoconical walls of the chimney 7 are provided with elongated outlets 7b regularly distributed over the periphery of said chimney 7, each of them extending radially along generatrices of the chimney 7 from the bottom 7a to a point close to the support wall 5b.

The collar 5 in turn has an outside shape mainly extending the spherical shape of the body 1 from the rim 3a to the support wall 5b, said collar 5 being provided over its entire outer periphery with recesses 5c intended to permit better gripping by the user of the attached assembly 6.

The measuring and dispensing device in this embodiment is provided with means given the general reference 8, intended to make it possible, as will be described further on, for the user to apply a certain amount of detergent liquid to areas of clothing requiring pretreatment. The means 8 comprise essentially a block of foam material or a pad 8a, of cylindrical shape, fitted at its base into a likewise cylindrical casing 9, the height of which is shorter than that of the cylinder 8a of foam material, while its inside diameter corresponds substantially to the outside diameter of said cylinder 8a of foam material. The casing 9 is provided at its end corresponding to one end of the cylinder 8a of foam material with a base 9a provided itself with a through hole 9b of substantial diameter. The outside diameter of the casing 9 corresponds substantially to the inside diameter of the support wall 5a of the collar 5. The means 8 can thus be fastened to the collar 5 and to the body 1 for the pretreatment stage, for which purpose the casing 9 fits into the support wall 5b. The casing 9 is in addition provided with two gripping depressions 9c extending in diametrically opposite positions on its periphery.

A measuring and dispensing device of this type is used in the manner which will now be described. The user first fills the body 1 with detergent liquid through the opening 3 and the outlets 7b in the chimney 7, and then, for pretreatment purposes, fastens the means 8 by fitting the casing 9 inside the cylindrical support wall 5b of the collar 5. The user then inverts the measuring and dispensing device so that the detergent liquid, passing through the outlets 7b and the opening 9b provided in the base 9a of the casing 9, impregnates the foam material of the pad 8a. The latter can then be used as an applicator pad for applying detergent liquid to a preselected area of a garment. Once the liquid has been sufficiently distributed over this area of clothing requiring treatment, the user can then carry out the treatment by rubbing said area with the outside face of the base 2 and the irregularities 2a provided on said surface. When the pretreatment stage has been completed, the user pulls out the application means 8, disconnecting said means from the collar 5, and then places the measuring and dispensing device, without the application means 8, into the drum of the washing machine together with the clothes. In the course of the washing cycle the detergent liquid progressively escapes from the body 1 by way of the outlets 7b.

Figure 3:
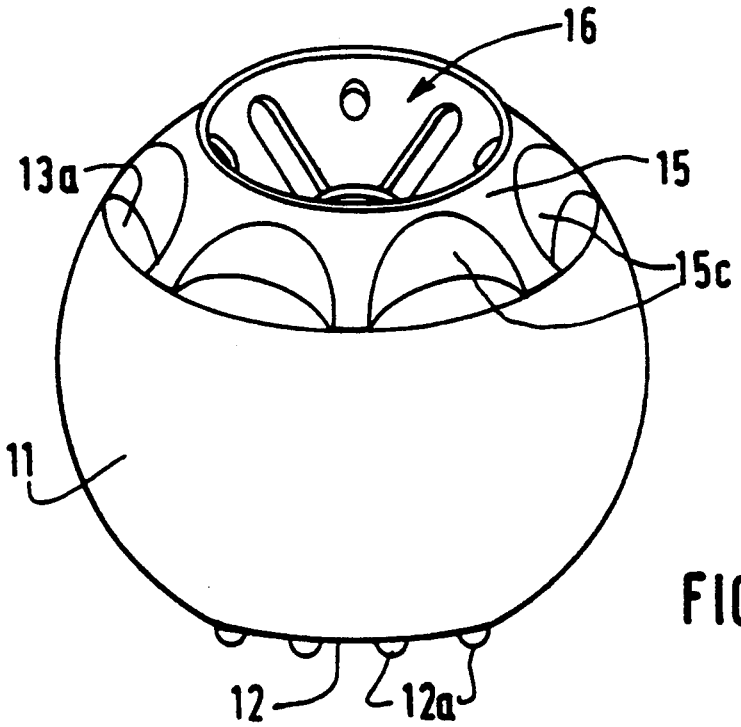
FIGS. 3 and 4 are respectively views in perspective of a measuring and dispensing device according to a second embodiment of the invention, and of the attached assembly of said measuring and dispensing device.
Figure 4:
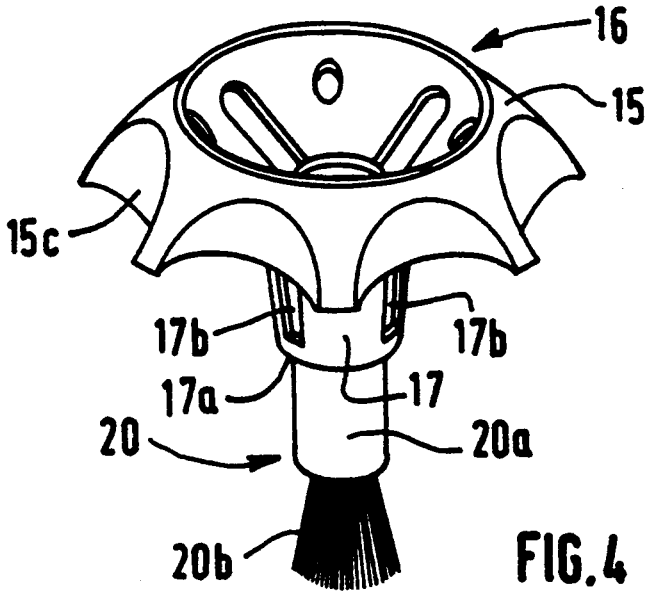

The variant of the measuring and dispensing device according to the invention which is shown in FIGS. 3 and 4 is very similar to that shown in FIG. 1 and 2, and for those elements shown in FIGS. 1 and 2 which are found again in this new variant the same reference numerals, increased by 10, are used once more. The measuring and dispensing device shown in FIGS. 3 and 4 comprises essentially a hollow body 11 of mainly spherical shape, associated with an attached assembly 16 provided with a collar 15 and a chimney 17. It differs from the device shown in FIGS. 1 and 2 essentially in that the application means with which it is provided, replacing the means 8 previously described, comprises a brush assembly 20 whose cylindrical handle 20a axially extends the chimney 17 beyond its base 17a. This handle 20a retains the bristles 20b of the brush, the height of said handle 20a and of said bristles 20b being such that, when the attached assembly 16 is in position over the opening of the body 11, said handle 20a and said bristles 20b extend inside said body 11 without the bristles 20b being crushed against the base 12 of the body 11.

For the purpose of utilizing this measuring and dispensing device, the user first fills the body 1! with detergent liquid, after having disconnected the attached assembly 16 from said body 11. He then dips the brush 20 into the detergent liquid, handling it by the gripping collar 15. When the bristles 20b of said brush 20 have been sufficiently impregnated, he spreads the detergent liquid by means of the brush over a preselected area of clothing and he can carry out the treatment by rubbing this area with the aid of the outer surface of the base 12 and the irregularities 12a. After having pretreated all the preselected areas of the clothing, the user puts the attached assembly 16 back in position over the opening of the body 11 and introduces the measuring and dispensing device into the drum of the washing machine.

Figure 5:
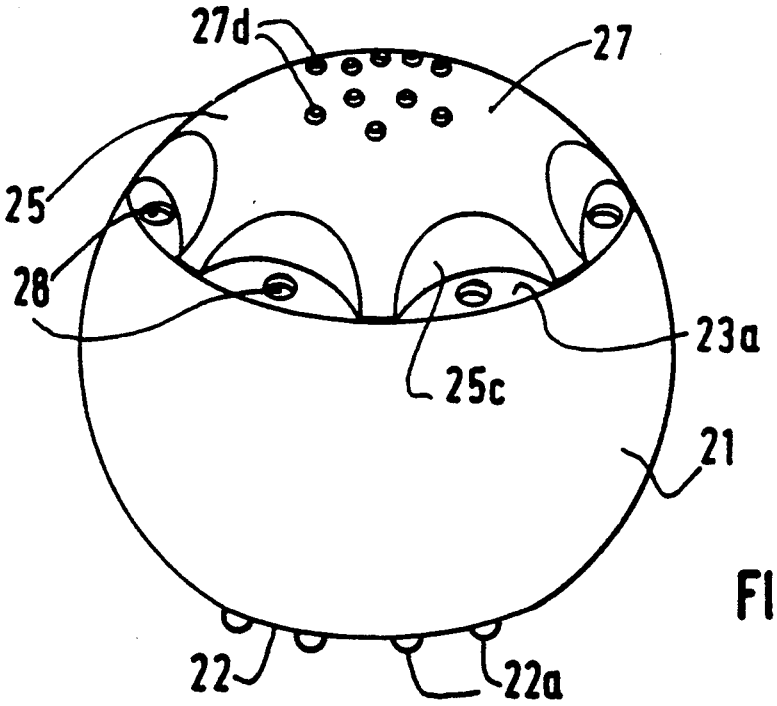
FIGS. 5 and 6 are two views in perspective of a measuring and dispensing device according to a third embodiment of the invention, shown in two different positions of use.
Figure 6:
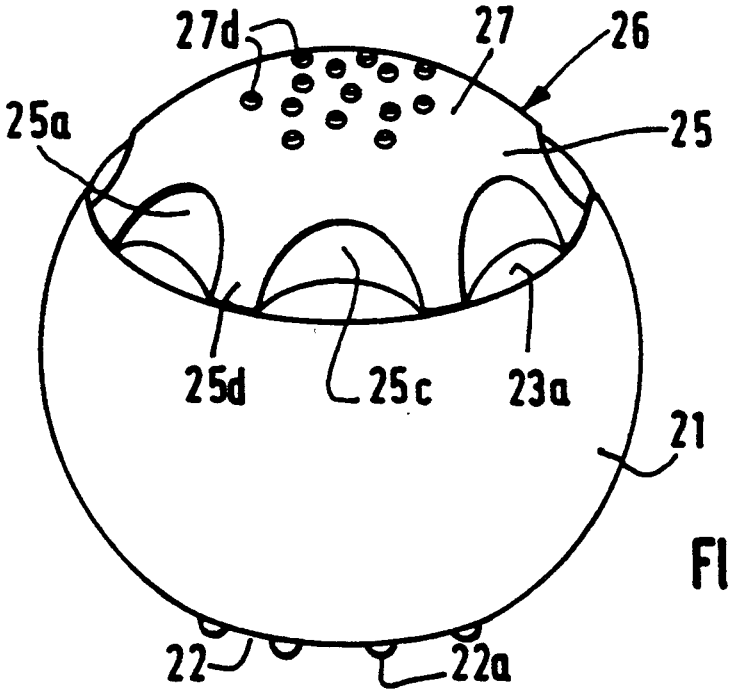

The measuring a dispensing device shown in FIGS. 5 and 6 comprises a body 21 which is substantially identical to that of the preceding variants and which is delimited by a base 22 and an opening delimited by an oppositely situated rim 23a. An assembly 26 forming a lid intended to be fitted on the body 21 with the aid of its collar 25, which is substantially of the same type as the collars of the attached assemblies previously described, is placed over the body 21 and the opening in the latter. The outer walls of said collar 25 are extended, at the level of the central part of the assembly 26 forming a lid, by a dome 27 having the shape of an arc of a sphere.

The rim 23a is provided with apertures 28 distributed regularly over its entire periphery. The number of these apertures corresponds to the number of depressions 25c provided in the collar 25 between the legs 25d of the latter. The lid assembly 26, when in place on the body 21, is adapted to pivot about the axis of said body 21 so as to assume two positions, one of which is shown in FIG. 5 where the apertures 28 are not closed, and the other of which is that shown in FIG. 6, where the apertures 28 are all closed by the legs 25d of the collar 25 which are positioned over them.

The dome 27 is in turn provided with a plurality of small apertures 27d distributed regularly in its central part.

When a user wishes to make use of this measuring and dispensing device in order to carry out pretreatment followed by washing, he fills the measuring and dispensing device with detergent liquid after detaching the lid assembly 26 from the body 21. After the device has been filled, he positions the lid assembly 26 on the body 21 in such a manner that, as illustrated in FIG. 6, the apertures 28 are all closed by the legs 25b of the collar 25. After inverting the measuring and dispensing device so that the lid part 26 is situated at the bottom in relation to the remainder of the body 21, the user can shake the measuring and dispensing device in a reciprocating movement in a substantially vertical direction, so as to deposit the desired amount of detergent liquid, which then passes out in a controlled manner from the small apertures 27*d*, on certain areas of the clothing. Just as previously, the user can immediately afterwards effect treatment by rubbing with the aid of the external surface provided with irregularities 22*a* on the base 22. When the pretreatment has been completed, the lid 26 has simply to be replaced on the body 21 in the potion shown in FIG. 5, so that each leg 25*d* is situated between two successive apertures 28 in the rim 23*a*, the manipulation of the lid assembly 26 on the body 21 being facilitated by the depressions 25*c*. The measuring and dispensing device can then be placed, together with the clothes, in the drum of the washing machine. In the course of the washing cycle the detergent liquid will escape from the device mainly through the outlets formed by the apertures 28.

Figure 7:
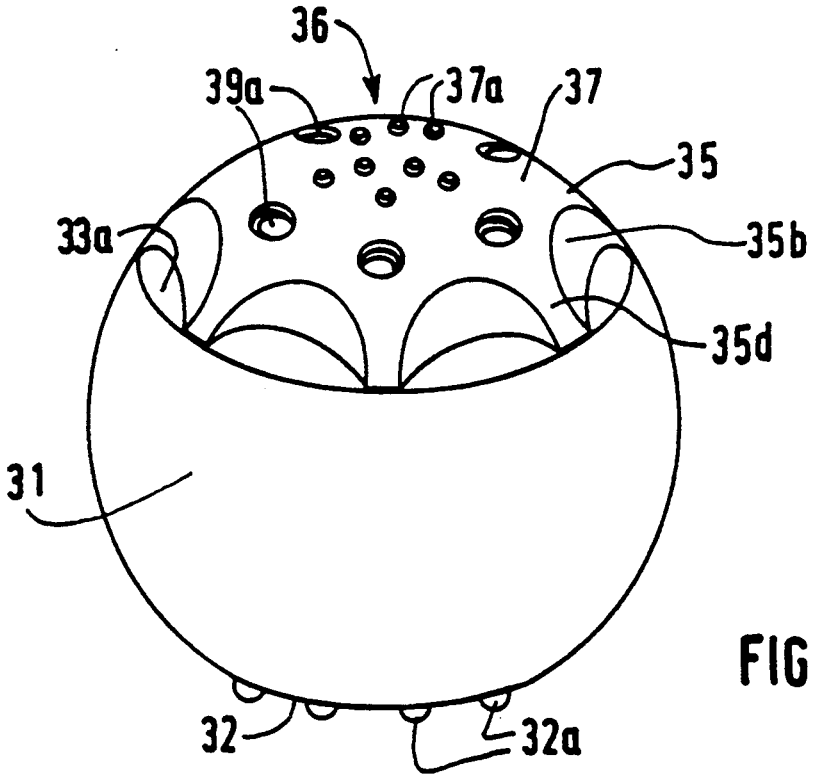
FIGS. 7 and 8 are views in perspective and in section of a measuring and dispensing device according to a fourth embodiment of the invention.
Figure 8:
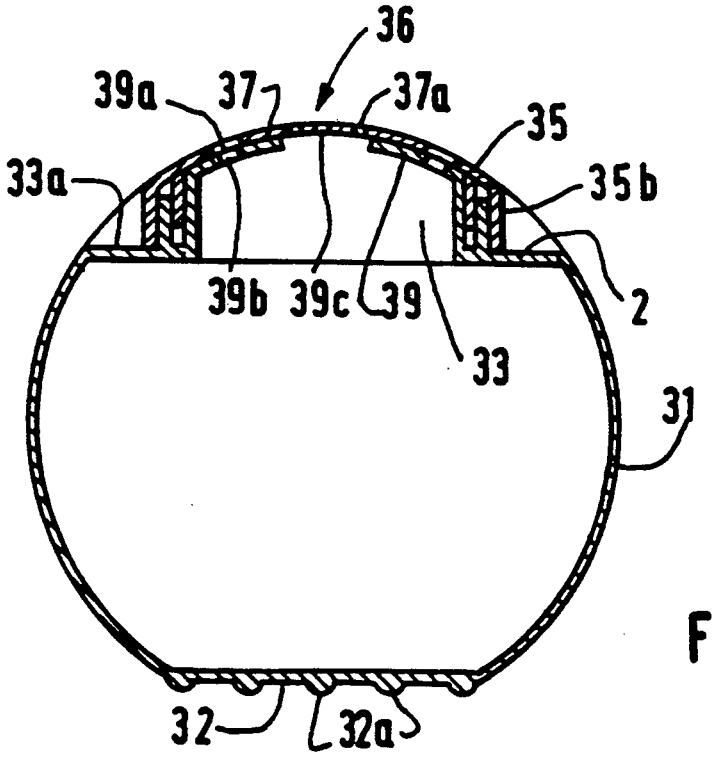

The principle of the measuring and dispensing device according to a fourth variant of the invention, which is illustrated in FIGS. 7 and 8, is substantially the same as that of the preceding device, and for elements of the previously described device shown in FIGS. 5 and 6 which are found again in the device shown in FIGS. 7 and 8, the same reference numerals, increased by 10, will be used again. It can be seen in FIGS. 7 and 8 that the device according to this possible variant of the invention comprises a body 31, a base 32 and an opening 33 over which is attached a lid 36 comprising a collar 35 and a dome 37. Said dome 37 is provided in its central part with small apertures 37*a*. The device of this new embodiment differs from the preceding embodiment essentially in that the rim 33*a* on which the collar 35 is fitted does not have an aperture for the progressive discharge of the detergent liquid in the course of the washing cycle, such apertures being replaced by apertures 39*a* distributed over the dome 37 near its outer periphery, substantially in line with each of the branches 35*d* of the collar 35. The opening contour of the rim 33*a* is extended by a cylindrical skirt 35, which at its end remote from the base 32 carries a sub-dome 39 the shape of which is complementary to that of the dome 37 and which is provided with small apertures 39*b* regularly distributed to correspond to the apertures 39*a*, the number of apertures 39*b* being equal to that of the apertures 39*a*, so that in one position (FIG. 8) of the lid 37 relative to the body 31 the apertures 39*a* and 39*b* face one another. The sub-dome 39 is in addition provided in its central part with an aperture 39*c* of large diameter, facing the zone of the dome 37 in which the small apertures 37*a* are distributed.

Just as previously, after having filled the measuring and dispensing device with detergent liquid, the user arranges the lid assembly 37 in a position relative to the body 31 such that the apertures 39*b* and the apertures 39*a* do not coincide, said apertures 39*a* and 39*b* facing solid parts of the dome 37 and sub-dome 39 respectively. Consequently, the detergent liquid cannot escape from the body 31 except through the apertures 37*a* through the action of manipulation in identical manner to that explained previously. The user can thus effect the pretreatment of the clothes. Before placing the measure and dispensing device in the drum of the washing machine together with the clothes, the user arranges the lid 37 in a position, relative to the body 31, such that the apertures 33 and 33*b* directly face one another. In the course of the washing cycle the lid 36, held by friction of the walls of its support zone 35a against the skirts 34*a* and 34*b* surrounding the opening 33 of the body 31, will remain in that position on said body 31. The detergent liquid then escapes progressively through the apertures 39*a* and 39*b*.

Figure 9:
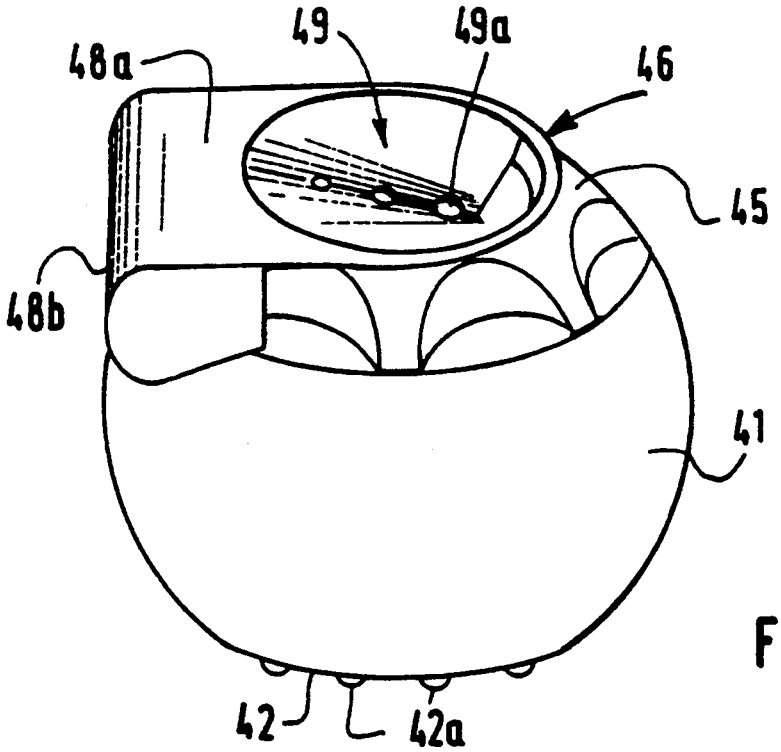
FIGS. 9 and 10 are views in perspective and in section of a measuring and dispensing device according to a fifth embodiment of the invention.
Figure 10:
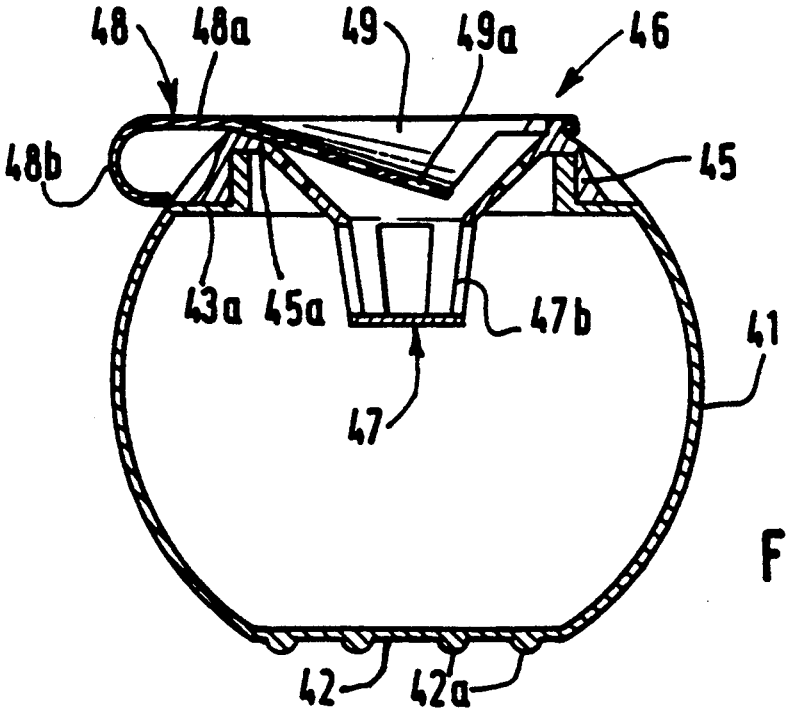

Referring now to FIGS. 9 and 10, it is seen that a measuring and dispensing device according to a fifth embodiment of the invention comprises a body 41 provided with a base 42 and associated with an attached assembly 46 which, like the devices of the variants illustrated in FIGS. 1 to 4, has a chimney-like opening 47. The collar 45 of this attached assembly 46 is provided with a protuberance 48 which extends over a height corresponding substantially to that of the collar 45. The face 48*b* of this protuberance remote from the axis of the body 41 is rounded and projects beyond the rim 43*a* and the wall of the body 41. The attached assembly 46 also has a- flat face 48*a* substantially parallel to the base 42 when the assembly 46 is placed in position on the device. This flat face 48*a* ends at an internal contour, having the shape of-an arc of a circle, of the collar 45. In addition, the protuberance 48 is supported on an opening half-contour of the chimney 47. At the site of the protuberance 48 the chimney 47 is provided in its interior with an incurved, inclined wall 49 forming a spout which extends to the level of the top cone of said chimney 47 (that is to say the opposite end to the base 42). This wall 49 is provided on its median line, in a diametrical plane of the device, with apertures 49*a* passing through its thickness. These three apertures may have diameters which increase when considered from the one closest to the protuberance 48 towards the one remote from the latter. This protuberance 48 is removable from the attached assembly 46. It could also be integral with the latter.

This measuring and dispensing device is used in the manner which will now be described. In order to effect the pretreatment, after having filled the body 41 with detergent liquid, the user tilts the device so that the rounded front face 48*b* of the protuberance is directed downwards. A controlled amount of detergent liquid then passes through the apertures 49*a* and the holes or outlets 47*b* onto the inclined, incurved wall 49 forming a spout and onto the flat upper face 48*a* of the protuberance 48. The user can then spread out this amount as he wishes over certain areas of the clothing with the aid of the rounded front face 48*b*; the level of the detergent liquid is then situated below the apertures 49*a* and cannot be poured out. Treatment by rubbing is also possible with the aid of the irregularities 42*a* on the base 42. In the course of the washing cycle the detergent liquid escapes from the measuring and dispensing device by way of the holes or outlets 47*b*.

Figure 11:
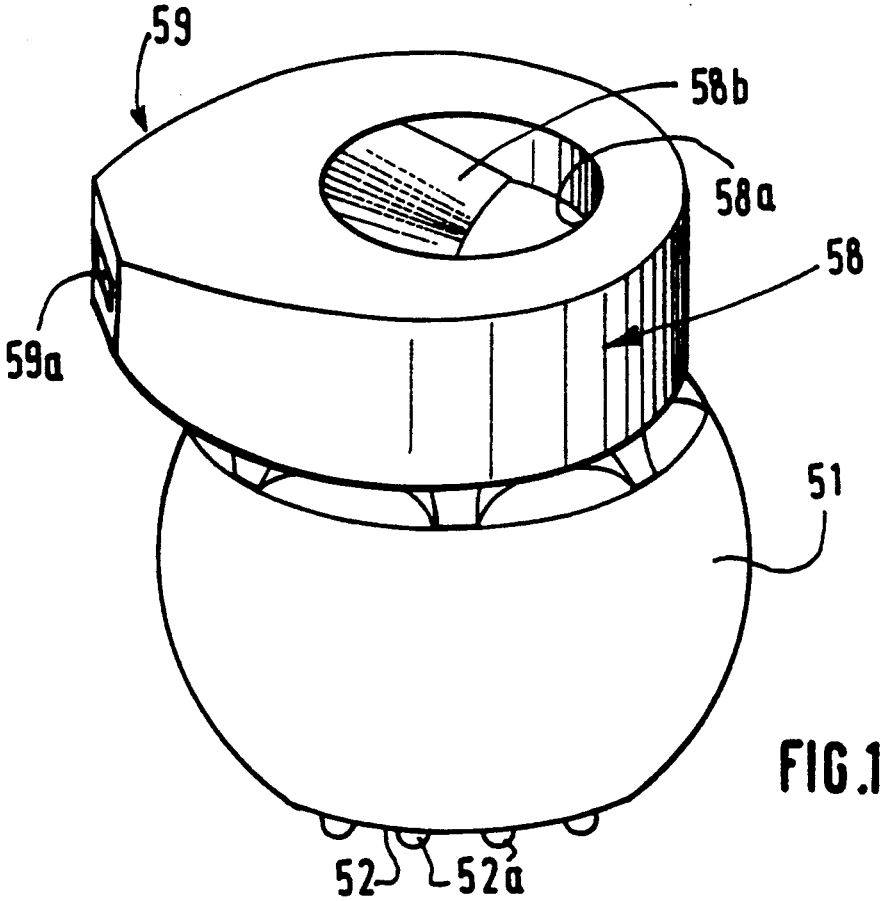
FIGS. 11 and 12 are views in perspective and in section of a measuring and dispensing device according to a sixth embodiment of the invention.
Figure 12:
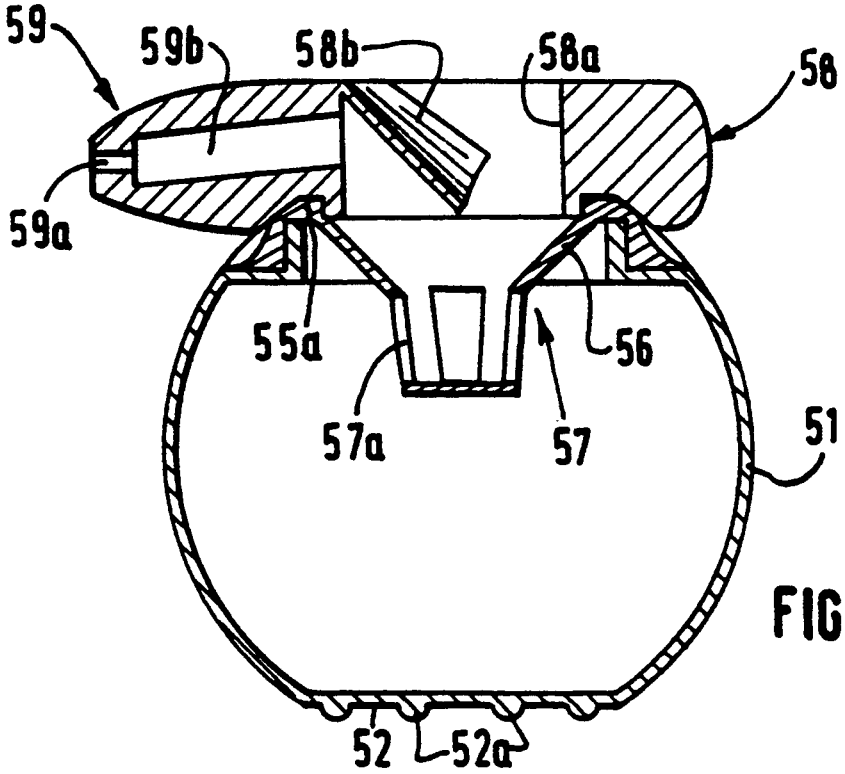

Another possible embodiment is further illustrated in FIGS. 11 and 12. It comprises a body 51 associated with an attached assembly 56, both these components being substantially identical to those of the measuring and dispensing device shown in FIGS. 1 and 2. This body 51 and the attached assembly 56 are associated with application means 58. Said means comprises essentially a pouring spout 59 formed in a component intended to fit onto the inside faces of the support walls 55*a* which delimit the opening of the chimney 57. Said pouring spout is situated at the end of a channel 59*a*, the other end of which leads into the interior of a cylindrical bore 58*a* which passes through the thickness of the application means 58 and the diameter of which is slightly smaller than the diameter of the opening of the chimney 57. This bore 58*a* is in addition partially closed by an inclined, incurved wall 58*b* which extends obliquely towards the interior of the bore 58*a*, as shown in the drawings.

A device of this kind is used in the manner which will now be described. The user first fills the body 51 with detergent liquid, then places said component 58 in position over the opening of the attached assembly 56, and thereupon inclines the measuring and dispensing device in such a manner that the spout 59 is situated in a low position relative to the remainder of the device. The detergent liquid, passing through the apertures and outlets 57*a* and then through the channel 59*a*, flows out through the spout 59, which the user directs as he wishes in order to spread out the liquid in a controlled manner over the areas of the clothing. The wall 58*b* makes it possible to prevent the detergent liquid from escaping to a large extent through the aperture 58*a* when the device is thus tilted. Once the pretreatment has been effected, the user disengages the means 58 from the opening of the attached assembly 56 and then places the measuring and dispensing device, without said means 58, inside the drum of the washing machine, together with the clothes. It is to be noted that said application means 58, which here are detachable from the body 51, could also be integral with the latter.

Figure 13:
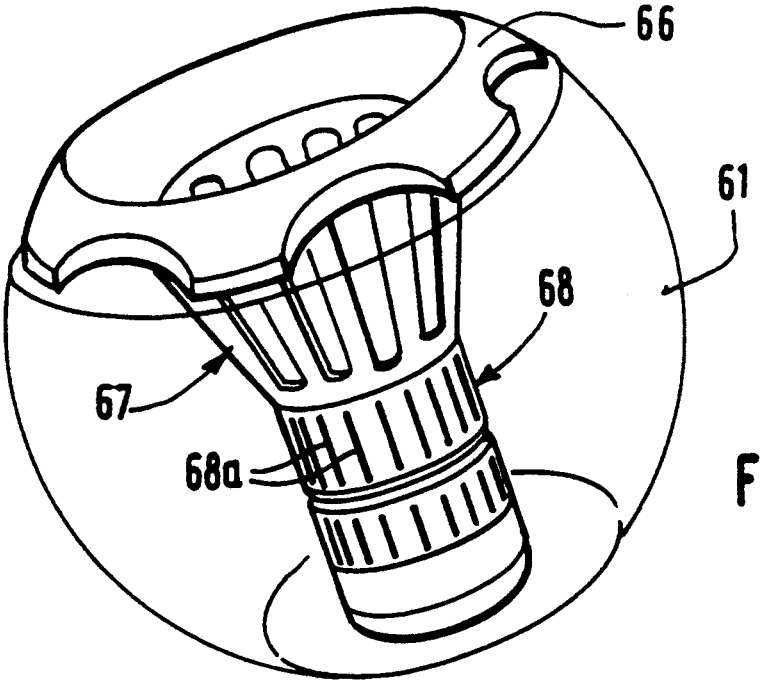
FIG. 13 is a view in perspective of a measuring and dispensing device according to a seventh embodiment of the invention.
Figure 14:
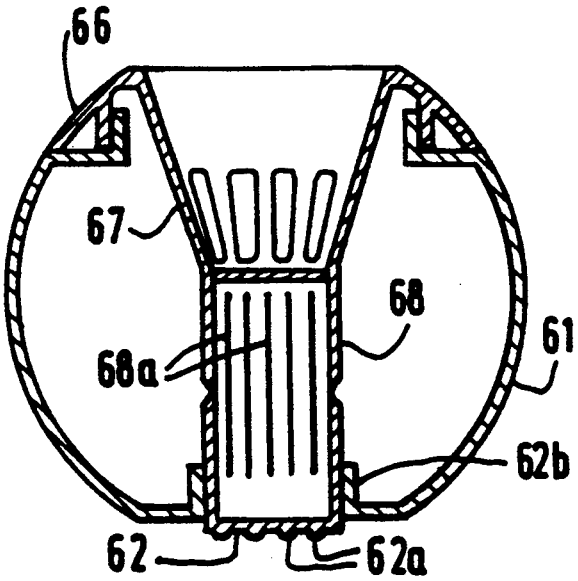
FIG. 14 is a view in axial section of the measuring and dispensing device shown in FIG. 13, as it is used in the course of the washing.
Figure 15:
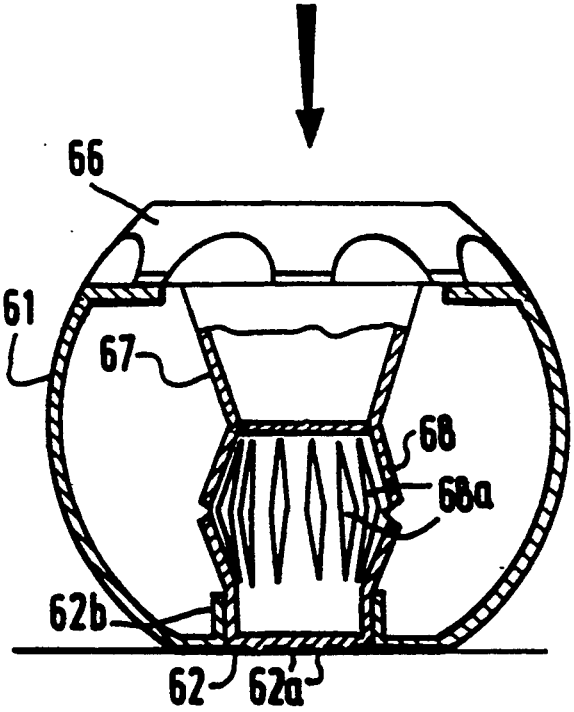
FIG. 15 is a view in axial section, partly broken away, of the device shown in FIG. 13, as it is used in the pretreatment stage.

Reference will now be made to FIGS. 13 to 15, which show a measuring and dispensing device according to another variant of the invention. This measuring and dispensing device comprises a body 61 of mainly spherical shape and associated with an attached assembly 66. The latter is provided with a chimney 67 which is extended, beyond its frustoconical base, by a cylindrical part 68 leading to an opening in the base 62 of said body 61. The opening formed in said base 62 is bordered by an annular cylindrical skirt 62*b* extending from said base 62 to the interior of the body 61 and making leak-tight contact with the walls of the part 68. This part 68, moreover, ends, outside the body 61, in a base 62 whose outside surface is provided with projecting irregularities 62*a* and has small interstices passing through it to permit the passage of the detergent liquid. The cylindrical walls of said part 68 are provided over a greater part of their height with slits 68*a* intended to serve as valves, the part 68 being deformable and adapted to assume two positions, one of which is a position of rest which it assumes when no compressive stress is applied between its two ends and in which said slits 68*a* are liquid-tight, while the other is a position (FIG. 15) in which said slits 68*a* are open and allow liquid to pass from outside to the interior of the part 68.

A device of this kind is used in the manner which will now be described. The user first fills the device with detergent liquid. The part 68 is then at rest and no liquid passes into its interior. In order to apply detergent liquid to areas which are to be pretreated, the user presses the bases 62 and 62*a*, as indicated by the arrow in FIG. 15, against the walls of the areas to be pretreated. The valve slits 68 open and the liquid passes into the interior of the part 68*a*, impregnating the base 62*a*, so that by rubbing the device to-and-fro over the clothing the user distributes a certain amount of detergent liquid over the latter, this liquid passing through said base 62*a* by way of the interstices provided in it. When the pretreatment is finished, the user places the measuring and dispensing device, together with the clothes, in the drum of the washing machine.

The embodiments described above with reference to the accompanying drawings constitute only illustrations of the means according to the invention and other variants are possible by modification of the shapes of the device and of the pretreatment means associated with it. In view of the fact that the device is intended to serve as a dispenser, after it has been placed inside the drum of the machine, it must not have any sharp edges capable of damaging the clothes. The shape of the body of the device and of the pretreatment means must therefore conform to this requirement in a manner known to those versed in the art. Preference should be given to rounded and curved shapes.

In addition, the materials of which the device of the invention is made are advantageously the plastics materials already proposed for this type of device, for example polyethylene, polypropylene, polyamide, although this list is not limitative. As those versed in the art are aware, plastics materials are very suitable for this type of device, on the one hand for making connections between the various component parts, for example by mating shapes, and on the other hand in order to withstand the conditions prevailing in the washing machine, namely a temperature which may reach values close to 100° C. in a medium having a basic pH Other measuring and dispensing devices are of course possible, without thereby departing from the scope of the invention. In particular, the attached assembly carrying a brush, shown in FIGS. 3 and 4, may be of a different construction from that described: this attached assembly may for example be a lid provided with outlets and with a flat base or a dome. In addition, the brush of this device may be replaced by any other similar applicator member, such as a pad or a ball.

Similarly, the arrangement of the rubbing means on the body of the device is not in any way critical. The surface irregularities may be provided in any suitable position on the base or the side walls of the body, including the edge of the flat surface constituting the base.

Similarly, gripping means could be provided if desired in the form of cavities or depressions in the body of the devices. This type of means is easy to produce during the moulding of the body of the device. The device could also have, in conventional manner, a plurality of compartments enabling the washing action of the detergent liquid to be supplemented by the actions of additive compositions.

With regard to the method of manufacture, injection moulding is very appropriate for plastics materials. In particular, it makes it possible to produce the body of the device and the associated pretreatment means.

Furthermore, the device of the invention may be used with widely varying formulations of washing products. As an example, a standard formulation of a detergent liquid and three compositions of additives are given in the following table.

| | Liquid detergent | Additives No. 1 | Additives No. 2 | Additives No. 3 |
|---|---|---|---|---|
| Linear alkylbenzene sulphonate | 13 | | | 5 |
| Sodium alkylsulphate | 2 | | | 2 |
| Alkylalcohol ethoxylates | 8 | | | 5 |
| Dodecenylsuccinic acid | | | | 17 |
| Zeolite | | | | |
| Polyacrylate polymer | | | | 4 |
| Citric acid | 3 | | | |
| Sodium citrate | | | 15 | |
| Oleic acid | 2 | | | |
| Perborate (PB1) | | 45 | 45 | 25 |
| Tetraacetylethylenediamine | | 16 | 16 | 9 |

-continued

| | Liquid detergent | Additives No. 1 | No. 2 | No. 3 |
|---|---|---|---|---|
| Diethylenetriamine penta-methylene phosphonic acid | 0.4 | | | |
| Zn phthalocyanine sulphonate | | | 0.04 | 0.015 |
| Protease (4.0 KNPU) | 0.9 | | | 1.25 |
| Amylase (125 KNU/g) | 0.09 | | | |
| Optical brightener | 0.16 | | 0.07 | |
| Silicate | | | | 2 |
| Carbonate | | | | 2 |
| Sulphate | | 39 | 24 | 19 |
| Complement to 100 | 59 | 0 | 0 | 0 |

We claim:

1. Equipment comprising a reusable measuring and dispensing device for use in the machine washing of clothes, said device comprising a hollow body closed at one end by a base and adapted to receive a predetermined amount of a product, said hollow body being provided with at least one filling opening and with outlets for distribution of said product, said device being adapted to be placed, together with clothes to be washed, in a drum of a washing machine, wherein said device is progressively emptied of said product during the course of a washing cycle, said device being further provided with pretreatment means for enabling a user to effect, once said device has been filled, a controlled application of a pretreatment amount of said product to selected areas of said clothes to accomplish a pretreatment of said areas before said washing cycle, said device, containing a residual amount of product remaining after said pretreatment, being introduced into said machine together with said clothes, and in that said pretreatment means are removable from said body of said device.

2. Equipment according to claim 1, wherein said pretreatment means is adapted to enable to said product to be distributed over said areas.

3. Equipment according to claim 2, wherein said pretreatment means comprises an applicator member adapted to receive said product by impregnation.

4. Equipment according to claim 3, wherein said applicator member comprises an applicator pad.

5. Equipment according to claim 4, wherein said applicator pad is adapted to be fixed sealingly in said filling opening.

6. Equipment according to claim 3, wherein said applicator member comprises a brush.

7. Equipment according to any one of claims 3, 4, 5, or 6, wherein said applicator member terminates in a handle fastened to an attached assembly adapted to be fixed sealingly in said filling opening of said device, said applicator member extending inside said body of said device when said attached assembly is in position in said filling opening.

8. Equipment according to claim 6, wherein said brush terminates in a handle fastened to an attached assembly adapted to be fixed sealingly in said filling opening of said device, said brush extending inside said body of said device when said attached assembly is in position in said filling opening, and wherein said handle extends an outlet chimney provided on said attached assembly.

9. Equipment according to claim 8, wherein the height of said brush does not exceed the height of said body of said device.

10. Equipment according to claim 1, wherein said device is provided with an attached assembly which forms a lid, said lid being provided with numerous small apertures intended to enable a user to spread by sprinkling said pretreatment amount of said product over said areas, said attached assembly being adapted to pivot on said body of said device between a position in which said lid closes said apertures and a position in which said apertures are not closed.

11. Equipment according to claim 10, wherein said body of said device is provided with outlets on a part which forms a rim at the level of said filling opening, said attached assembly forming a lid adapted to pivot on said part and being provided on its periphery with closure legs which are disposed and shaped in such a manner that, in one position of said attached assembly on said body, said outlets are closed by said legs, said legs being placed over said outlets, and in another position said outlets are no longer closed.

12. Equipment according to claim 10, wherein said attached assembly has a dome-shaped lid part, said body being provided with a complementary sub-dome equipped with distribution outlets, said dome-shaped lid part being provided with complementary outlets which, in one position of said attached assembly in relation to said body, are adapted to assume a juxtaposed position relative to said distribution outlets in order to establish communication between the interior of said device and the exterior and, in another position, to interrupt said communication.

13. Equipment according to claim 1, wherein said pretreatment means comprises a member fastened to said body of said device or to an assembly attached to said body, said member having a pouring spout or channel communicating with the interior of said body when said member is in position on said body or on said assembly attached to said body.

14. Equipment according to claim 1, wherein said body has a wall forming a valve which, depending on whether or not said valve is subjected to a stress, controls communication between the interior of said device and a product application member.

15. Equipment according to claim 14, wherein said product application member comprises a hollow tube which extends inside said body of said device, passing through said base and terminating, outside said device, in an application surface, the wall which delimits said tube in the interior of said body being deformable and provided with at least one slit forming a valve which, if a compressive force sufficient to deform said wall is applied to said application surface, will open and bring the interior of said body into communication with the interior of said hollow tube, thus enabling said product to reach said application surface.

16. Equipment according to claim 15, wherein said application surface is provided with irregularities.

17. Method of utilizing the equipment according to claim 1, wherein said device is filled with a total amount of liquid detergent prescribed for a wash, a controlled pretreatment amount of said total amount of liquid detergent is applied to selected areas of said clothes with the aid of said pretreatment means, and said device is then placed in said drum of said washing machine together with said clothes, said device containing the residual amount of said detergent remaining after said pretreatment amount is applied to said clothes.

18. Process for pretreating and washing clothes in a washing machine, comprising the following steps:

(a) a dosage of the total quantity of liquid detergent to be utilized during a washing cycle is introduced into a measuring and dispensing device;

(b) said clothes are pretreated with a controlled pretreatment quantity of said total liquid detergent dosage contained in said device; and (c) said clothes and said device containing the residual quantity of liquid detergent remaining after said pretreatment quantity is applied to said clothes are placed in a drum of said washing machine, such that the residual quantity of liquid detergent is used for said washing cycle.

* * * * *